United States Patent [19]

Smith et al.

[11] Patent Number: 4,559,647

[45] Date of Patent: Dec. 24, 1985

[54] CONVERTIBLE GARMENT

[76] Inventors: Rae Smith, 356 Devon St., Stratford, Ontario, Canada, N5A 2Z9; Patricia Moratto, 4 Walford Rd., Toronto, Ontario, Canada, M8X 2P1

[21] Appl. No.: 648,808

[22] Filed: Sep. 10, 1984

[51] Int. Cl.[4] ..... A41D 27/10

[52] U.S. Cl. ..... 2/158; 2/170; 2/207

[58] Field of Search ..... 2/158, 170, 207

[56] References Cited

U.S. PATENT DOCUMENTS

| | | | |
|---|---|---|---|
| 1,285,917 | 11/1918 | Bradley et al. | 2/158 X |
| 1,296,966 | 3/1919 | Kaufman | 2/158 X |
| 1,310,120 | 7/1919 | Kreamer | 2/158 |
| 2,321,091 | 6/1943 | Kertesz et al. | 2/170 X |
| 2,323,136 | 6/1943 | Johanson | 2/158 |
| 2,603,790 | 7/1952 | Boehm-Myro | 2/158 |
| 2,830,299 | 4/1958 | Thilenius | 2/158 |
| 2,836,828 | 6/1958 | Henrikson | 2/170 X |
| 2,942,442 | 6/1960 | Lohs | 2/158 X |
| 4,359,784 | 11/1982 | Harrington | 2/158 X |

*Primary Examiner*—Louis K. Rimrodt

[57] ABSTRACT

A garment convertible from scarf to mitts is formed by a tubular member with a central arms receiving opening to allow the wearer's arms to extend through the tubular member and through a collar at each distal end, which collar when folded over converts into a cuff. Cooperating with the collar is an overlying flap formed into a pocket positioned with a mouth opening facing, but on the reverse side from, the arm receiving opening, and designed to reversingly fold over and cover the finger tips of the wearer. A protuberance in the tubular member is defined near each collar for accommodating the thumbs, whereby a mitten is formed. In another embodiment, a singular sleeve can have the mitten and thumb accommodating protuberance combination near the collar.

11 Claims, 19 Drawing Figures

CONVERTIBLE GARMENT

BACKGROUND OF THE INVENTION

This invention relates to a convertible garment and more particularly to a garment convertible either from scarf to mitts or from cuffs to mitts.

In the early fall and spring one frequently wears a scarf to protect the open exposure of the neck. Occasionally it turns cool. If gloves or mittens have been forgotten, one's hands become cold.

SUMMARY OF THE INVENTION

One embodiment of the invention provides a scarf whose ends convert into mittens so that when the scarf is worn, mittens are inherently available.

In another embodiment, a pair of sleeves are provided with distal ends that are collared to fold and to structure a mitt to cover the hand of a wearer.

More specifically, in one aspect the invention consists of a convertible garment as a combination cuff and mitt comprising (a) a tubular fabric member having a distal and a proximate end, the distal end being formed as a collar reversingly foldable to form a cuff for embracing the wrist of a wearer; (b) a protuberance with a closed tip positioned proximate the collar to accommodate the thumb of a wearer, the collar extending beyond the closed tip to cover the fingers of the wearer; and (c) a flap formed as an overlaying portion on the collar and mating therewith to form a pocket with an open mouth positioned between the tip and the distal end of the collar, a bottom of said pocket being disposed between the mouth and the distal end.

In another aspect of the invention consists of a convertible garment as a combination scarf transformable to mitts comprising (a) a tubular fabric member having distal ends formed as collars reversingly foldable to form cuffs for embracing the wrist of a wearer; (b) the tubular member having in its central region at least one arm receiving opening for extension of the hands beyond the collar; (c) a protuberance positioned proximate each collar to accommodate a thumb of wearer, each collar extending beyond the distal end of the protuberance by at least the length of said protuberance to cover the fingers of the wearer; (d) a flap formed as an overlaying portion on the collar and mating therewith to form a pocket with an open mouth positioned between the tip and the distal end of the collar, a bottom of said pocket being disposed between mouth and the distal end.

BRIEF DESCRIPTION OF THE DRAWINGS

FIGS. 13*a* and 13*b*, armpit length sleeves to mittens; FIGS. 13*c* and 13*d*, short and medium sleeve lengths to mittens; FIG. 13*e*, a sweater with a wrist band, according to the invention that converts to mittens; and FIG. 13*f*, an overcoat with a wrist band/mittens sewn into it. FIGS. 13*a*, 13*c* and 13*d* are taken on lines XIIIa—XIIIa, XIIIc—XIIIc and XIIId—XIIId respectively in FIG. 9.

DETAILED DESCRIPTION OF EMBODIMENTS OF THE INVENTION

Figure 3:
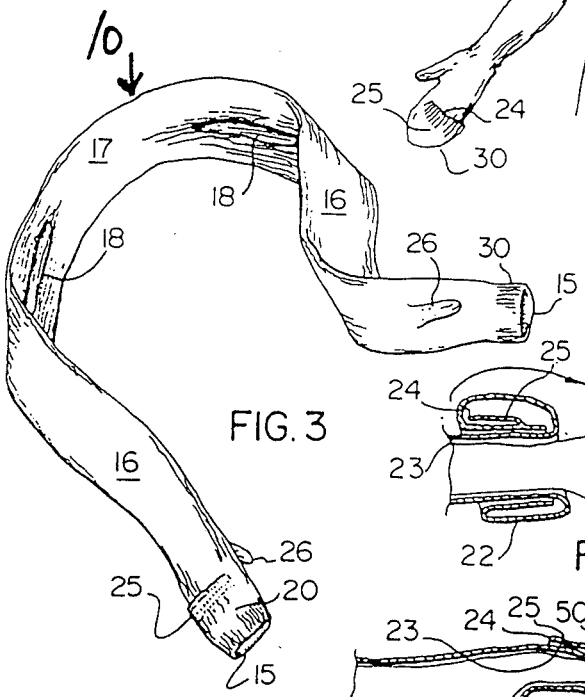
FIG. 3 illustrates the garment alone and its features.
Figure 4:
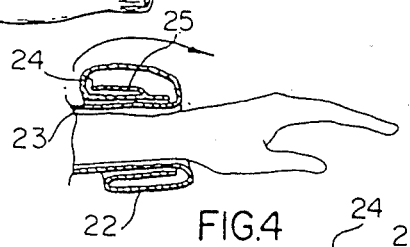
FIGS. 4, 5*a*, 5*b* and 6 are sections through a distal end of the garment of FIGS. 1 through 3, illustrating the conversion from wrist accommodating cuff to mittens over the hand of a wearer, FIGS. 5*a* and 5*b* showing variant positions of a pocket bottom.

Referring now to FIGS. 1 through 6, the garment 10 is generally of tubular fabric or of flat fabric with a seam (not shown) joined to form a tubular construction. It is preferably knitted material using any convenient knitting pattern or stitch. It has distal ends 15, a central or back region 17 with two lateral, arm accommodating openings 18 through which the arms of the wearer can extend into sleeve regions 16 so that the hands 30 extend beyond the distal ends 15. Each distal end 15 is shaped into a collar 20, so as, when folded over (as seen in FIG. 4 and on the left arm of FIG. 1), to form a wrist engaging cuff 22. When so folded, a portion of the collar 20 covers a flap 25 that has an open mouth 24 to form a pocket. The mouth 24 faces toward the arm accommodating opening 18, but is on the reverse side of the sleeve 16 from the opening 18. A proturberance 26 is formed near the collar 20, but in the sleeve portion 16 of the garment, essentially on the same side as the opening 18. This protuberance 26 acts as a thumb accommodating region when the garment is formed into a mitt as will be now described.

Figure 1:
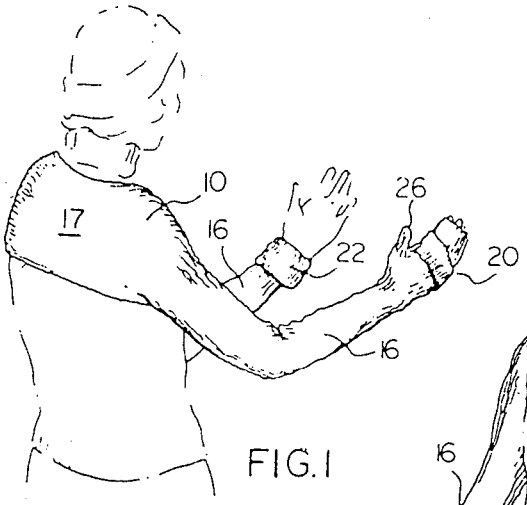
FIGS. 1 and 2 illustrate a garment according to the invention when worn and converted simplistically from a scarf to an arm warmer and into mittens.
Figure 2:
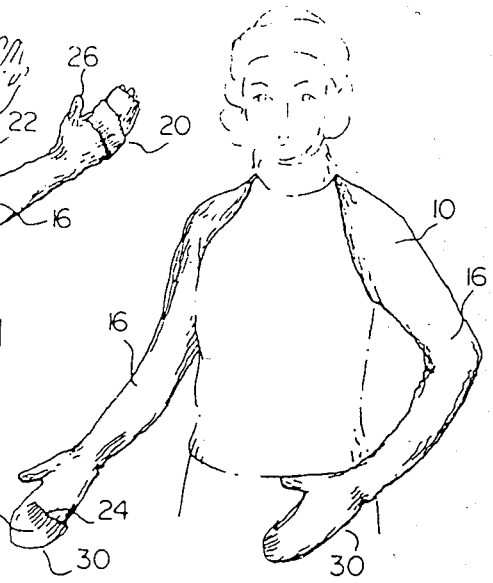

The garment of FIG. 3 may be worn as a scarf in typical fashion or, the wearer, when it is cold and he wishes to keep his arms covered, can extend his arms through the openings 18 and the sleeves 16 so the centre portion 17 covers his back as seen in FIG. 1. In FIG. 1 the left hand thumb protuberance 26 is subjacent the left cuff 22 and hence is not seen, while in the same figure the right arm is shown with the wearer's thumb in the protuberance 26, the collar 20 extending outward and forward as in FIG. 5. The flap 25 which defines a pocket is then pulled forward over the tips of the fingers of the wearer, as shown by the arrow in FIG. 5, and the mitten of FIG. 6 is thus formed. See also FIG. 2.

Figure 5A:
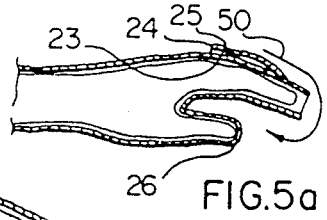
Figure 5B:
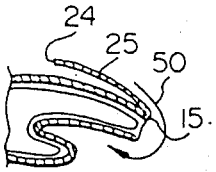
Figure 6:
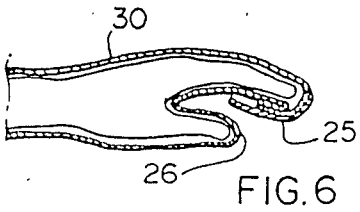
Figure 7:
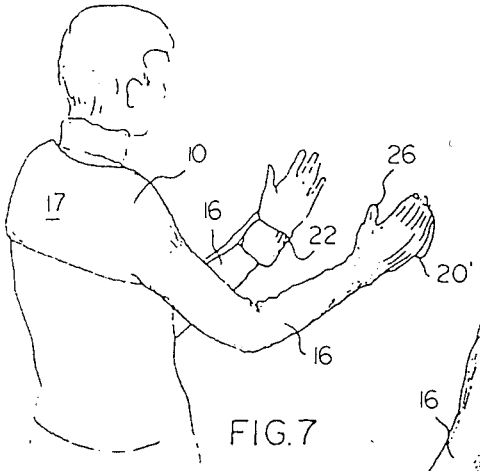
FIGS. 7 through 12, correspond to FIGS. 1 through 6 but illustrate a further and preferred embodiment of the invention, convertible from scarf to mittens.

The variant of FIGS. 5*a* and 5*b* is that the base or bottom of the pocket 25 is shown in FIG. 5*b* as located on the distal end 15 of the collar 20, while in FIG. 5*a* it is at an intermediate position between the distal end 15 and protuberance 26.

Figure 8:
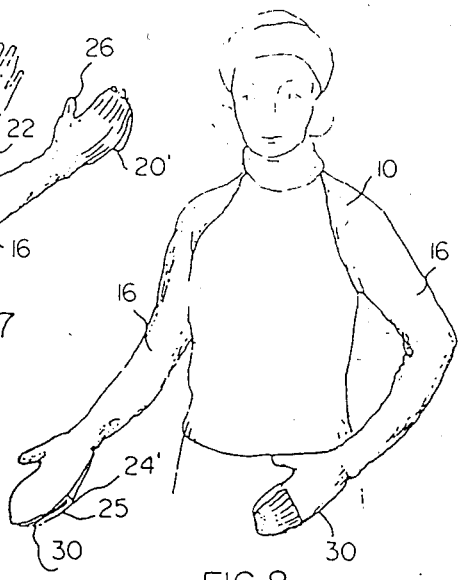
Figure 11:
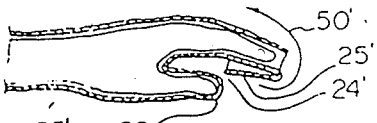
Figure 12:
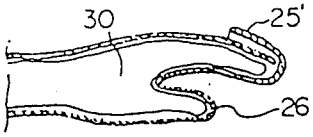

Referring to the preferred embodiment of FIGS. 7 through 12, which respectively correspond to FIGS. 1 through 6, there is here only a single opening 18, rather than two openings, and the pocket formed with the flap 25 is on the opposite side, as at 25', with the base of the pocket at the distal end 15. As best seen in FIGS. 11 and 12, the flap 24' folds over the tips of the fingers, in accordance with arrow 50' of FIG. 11, to come to the closed and overlapping position shown in FIG. 12, the "mouth" of the pocket 25' overlapping the upper or back portions of the fingers as shown. This embodiment is preferred, since the palm of the hand, as illustrated in FIG. 8, is smooth and clean, since the pocket is on the reverse side, i.e. over the knuckles as shown in the left hand arm of that figure, rather than over the internal digits and palm as shown in the equivalent figure, FIG. 2.

Figure 9:
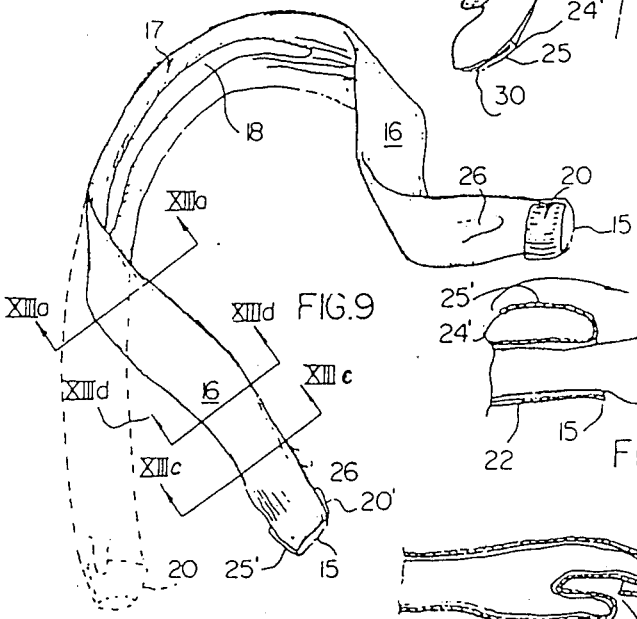
Figure 10:
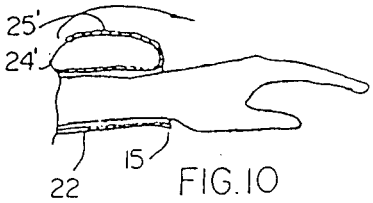

Referring to FIG. 9, section lines XIIIa—XIIIa, XIIIc—XIIIc and XIIId—XIIId illustrate that the back portion 17 may be eliminated, thereby providing two discreet sleeves 16 or cuffs, one for each arm, each section being of various possible sleeve lengths.

Figure 13A:
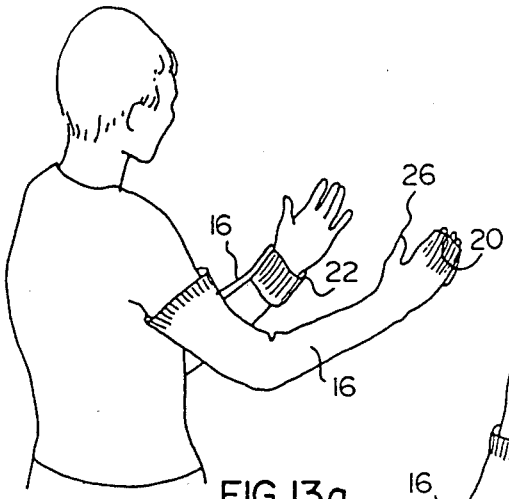
FIGS. 13*a* to 13*f* illustrate various alternative cuffs and mittens.
Figure 13B:
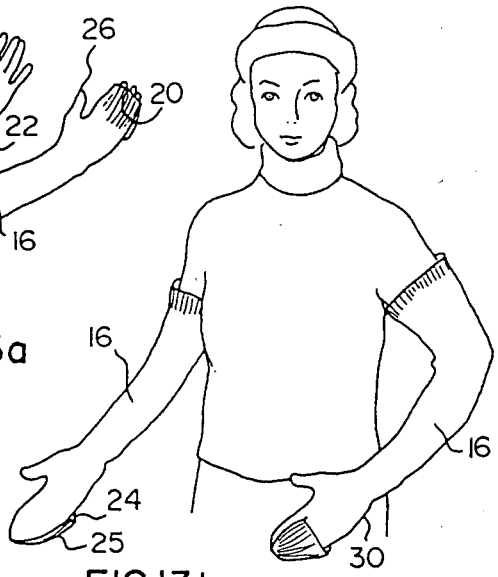

FIGS. 13*a* and *b* illustrate an armpit length sleeve with convertible mitt, converting in the fashion illustrated in FIGS. 7 through 12. In this case the proximate end is spaced from the protuberance a distance of about seven times the distance from the protuberance to the distal end.

Figure 13C:
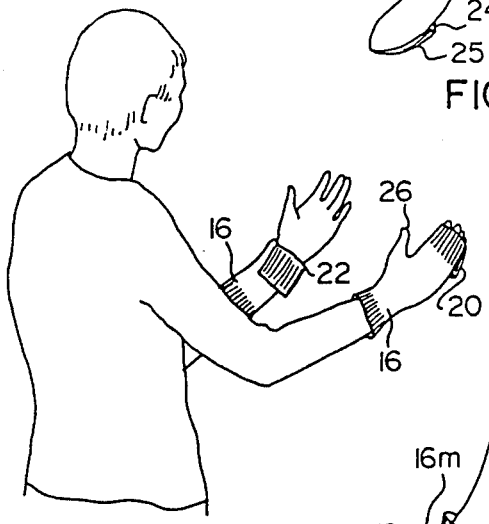
Figure 13D:
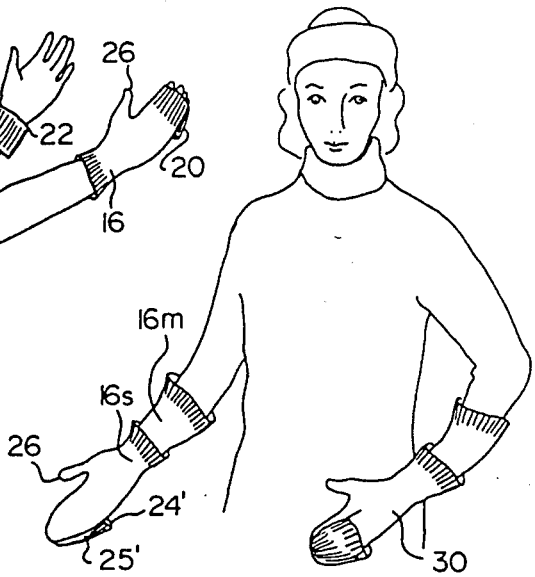

FIG. 13*c* illustrates a glove sleeve, while FIG. 13*d* illustrates a short length sleeve 16*s* and a midlength sleeve 16*m* with the pocket 25' of the preferred embodiment. In these respective cases the proximate end is spaced from the protuberance either a distance no greater than the distance from the protuberance to the distal end, or a distance between one and three times the distance from the protuberance to the distal end. In these references to distances from the protuberance, such distances are measured from the base of such protuberance where it joins the remainder of the fabric.

Figure 13E:
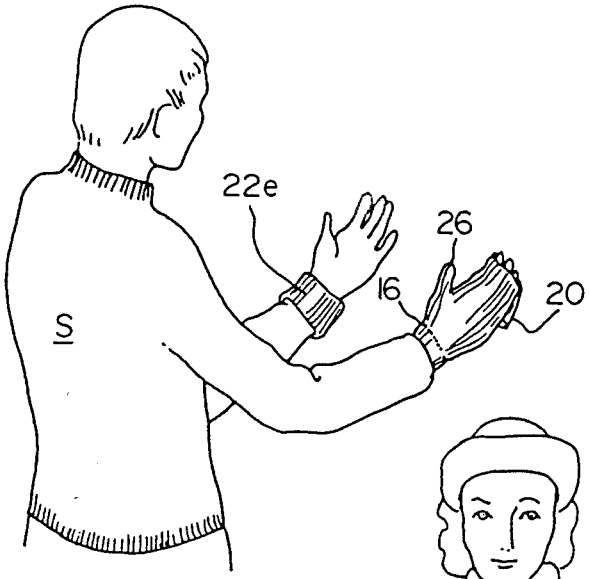

FIG. 13*e* illustrates a sweater S having a storm cuff 22*e* that folds forwardly and extends into a glove/mitt of the structure illustrated in FIGS. 7 through 12.

Figure 13F:
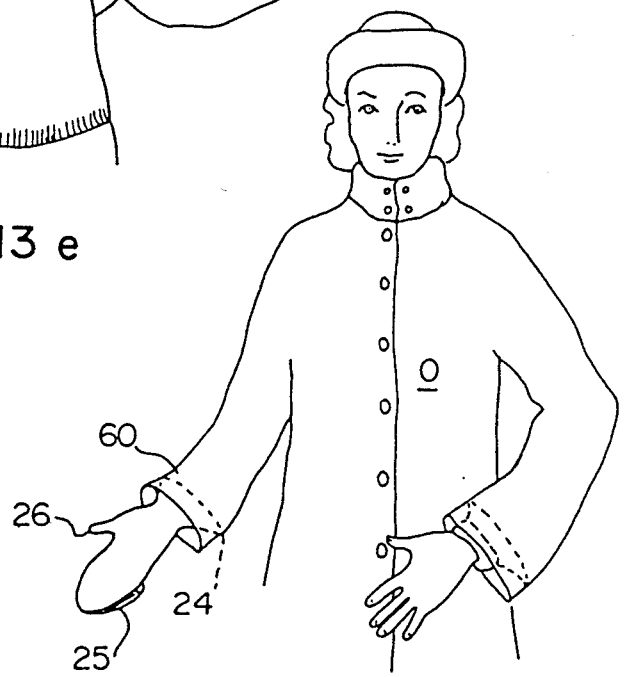

FIG. 13*f* illustrates an overcoat O wherein the sleeve of FIG. 13*e* is stitched into the distal end of the cuff 60 of the overcoat O so that on the right hand side the same is extended to form a mitten in the fashion of FIGS. 7 through 12 and on the left hand arm is folded back to form a conventional storm cuff.

Hence the garment of FIGS. 1 through 12 may be severed along the plurality of section lines illustrated in FIG. 9, or other variations thereof that are convenient to transform the convertible scarf into a pair of independent sleeves with tips convertible into mittens so formed. The length of the sleeves in any of the embodiments can vary, extending from shoulder to cuff or from elbow to cuff or any variation thereof.

Similarily, although the preferred embodiment is described and depicted in relation to knitted material, the material may also be composed of fabric, synthetic products, or leather, so that they can be used for industrial usages to protect the hands of a worker from caustic action or otherwise.

Those skilled in the art will appreciate that other adaptations and variations of the invention are possible, without departing from the spirit of the invention as claimed, including knitting and weaving of the fabric using various stitches, knits and ribbing and of materials such as cotton, wool or synthetics, to fashion esthetic and pleasing garments.

We claim:

1. A convertible garment as a combination cuff and mitt comprising:

(a) a tubular fabric member having a distal and a proximate end, the distal end being formed as a collar reversingly foldable to form a cuff for embracing the wrist of a wearer;

(b) a protuberance with a tip closed to prevent ingress of cold air from the exterior and positioned proximate the collar to accommodate the thumb of a wearer, the collar extending beyond the closed tip to cover the fingers of the wearer; and (c) a flap formed as an overlaying portion on the outside of the collar for folded-over mating therewith to form an outer pocket with an open mouth positioned between the tip and the distal end of the collar and facing away from such distal end whereby to effectively close such distal end against ingress of cold air.

2. The garment claimed in claim 1, wherein the proximate end is disposed a distance from the protuberance no greater than the distance between the distal end and the protuberance.

3. The garment claimed in claim 1, wherein the proximate end is disposed a distance from the protuberance between 1 and 3 times the distance from the protuberance to the distal end.

4. The garment claimed in claim 1, wherein the proximate end is disposed from the protuberance a distance no greater than 7 times the distance from the protuberance to the distal end.

5. The garment claimed in claim 1, wherein the pocket is disposed so one of its marginal extremities is proximately positioned to the protuberance and the mouth opening of the pocket extends away from the distal end.

6. The garment claimed in claim 1, wherein the mouth opening overlies the fingers of the wearer.

7. The garment claimed in claim 1, wherein the mouth of the pocket extends over the knuckles of the wearer.

8. The garment claimed in claim 1, wherein the mouth of the pocket extends over the palm of the wearer.

9. A convertible garment as a combination scarf transformable to mitts comprising:

(a) a tubular fabric member having distal ends formed as collars reversingly foldable to form cuffs for embracing the wrist of a wearer;

(b) the tubular member having in its central region at least one arm receiving opening for extension of the hands beyond the collar, the tubular member being a closed tube except for the or each arm receiving opening whereby fully to surround each arm from the armpit to the collar;

(c) a protuberance positioned proximate each collar to accommodate a thumb of a wearer, said protuberance being closed to prevent ingress of cold air from the exterior, and each collar extending beyond the distal end of the protuberance by at least the length of said protuberance to cover the fingers of the wearer; and (d) a flap formed as an overlaying portion on the outside of the collar for folded-over mating therewith to form an outer pocket with an open mouth positioned between the tip and the distal end of the collar and facing away from such distal end whereby to effectively close such distal end against ingress of cold air.

10. The garment of claim 9, wherein the mouth of the pocket is positioned on the reverse side of the fabric to the arm receiving opening.

11. A garment of claim 9, wherein the mouth of the pocket is positioned on the same side of the fabric as the arm receiving opening.

* * * * *